US009944509B2

(12) United States Patent
Rumigny et al.

(10) Patent No.: US 9,944,509 B2
(45) Date of Patent: Apr. 17, 2018

(54) DISPENSING DEVICE FOR A DRINK BASED ON ONE FLUID AND/OR A SECOND FLUID

(71) Applicant: DECATHLON, Villeneuve d'Ascq (FR)

(72) Inventors: Pascal Rumigny, Lille (FR); Johann Guerizec, Faches/Thumesnil (FR); Thibaut Guiraudie, La Madeleine (FR)

(73) Assignee: DECATHLON, Villeneuve d'Ascq (FR)

( * ) Notice: Subject to any disclaimer, the term of this patent is extended or adjusted under 35 U.S.C. 154(b) by 0 days.

(21) Appl. No.: 15/256,043

(22) Filed: Sep. 2, 2016

(65) Prior Publication Data

US 2017/0066640 A1 Mar. 9, 2017

(30) Foreign Application Priority Data

Sep. 7, 2015 (FR) ..... 15 58252

(51) Int. Cl.
*B67D 3/02* (2006.01)
*B65D 81/32* (2006.01)
(Continued)

(52) U.S. Cl.
CPC ..... *B67D 3/02* (2013.01); *B65D 47/2056* (2013.01); *B65D 81/3227* (2013.01);
(Continued)

(58) Field of Classification Search
CPC ..... A61M 5/00; A47G 19/2272; B67D 3/02; B67D 3/008; B65D 35/22; B65D 47/2272;
(Continued)

(56) References Cited

U.S. PATENT DOCUMENTS 3,850,346 A * 11/1974 Richardson ..... B65D 81/3227 222/144.5
4,355,739 A * 10/1982 Vierkotter ..... B05B 11/3083 222/134
(Continued)

FOREIGN PATENT DOCUMENTS

EP 1948531 A2 7/2008
WO WO-2007027654 A2 3/2007

*Primary Examiner* — Nicholas J Weiss
*Assistant Examiner* — Andrew P Bainbridge
(74) *Attorney, Agent, or Firm* — Marshall, Gerstein & Borun LLP

(57) ABSTRACT

Dispensing device for a drink based on a first fluid to which a second fluid can be added selectively, including a support containing a chamber having a first port communicating with a reservoir of said first fluid, a second port communicating with a reservoir of the second fluid, and an outlet port, further including a dispensing assembly mounted movably relative to the support following: a first displacement arranged to selectively open and close the outlet port and/or the first port by a first actuating element for the first displacement; and a second displacement arranged to open and close the second port selectively by a second element to enable the actuation of the second displacement; the second element being arranged to be actuated after the first element and following a type of motion different to the type of motion necessary for the actuation of the first element.

17 Claims, 9 Drawing Sheets

(51) Int. Cl.

| | |
|---|---|
| ***B65D 47/20*** | (2006.01) |
| ***B67D 3/00*** | (2006.01) |
| *B65D 47/08* | (2006.01) |
| *A47G 19/22* | (2006.01) |
| *B65D 47/24* | (2006.01) |
| *B65D 35/22* | (2006.01) |
| *B65D 83/68* | (2006.01) |

(52) U.S. Cl.
CPC ..... *B65D 81/3244* (2013.01); *B67D 3/008* (2013.01); *A47G 19/2272* (2013.01); *B65D 35/22* (2013.01); *B65D 47/0819* (2013.01); *B65D 47/242* (2013.01); *B65D 47/244* (2013.01); *B65D 83/682* (2013.01)

(58) Field of Classification Search
CPC .. B65D 1/04; B65D 81/3244; B65D 81/3227; B65D 81/3283; B65D 83/682; B65D 47/2056; B65D 47/0819; B65D 47/242; B65D 47/244
USPC ..... 215/6, 10, 329, 397; 222/129, 144.5, 222/145.5–145.8, 206–215, 519–525, 222/545–546, 548–555, 560
See application file for complete search history.

(56) References Cited

U.S. PATENT DOCUMENTS 4,838,457 A * 6/1989 Swahl ..... B65D 35/28 222/105
4,893,729 A * 1/1990 Iggulden ..... A61K 8/02 222/134
4,964,541 A * 10/1990 Gueret ..... B65D 83/685 222/129
4,993,594 A * 2/1991 Becker ..... B01F 13/002 137/607
5,339,990 A * 8/1994 Wilder ..... B05B 11/3084 222/135
5,680,962 A * 10/1997 McEleney ..... A61K 8/4973 222/129
5,890,624 A * 4/1999 Klima ..... B05B 11/00 222/129
6,299,023 B1 * 10/2001 Arnone ..... B05B 11/3083 222/105
6,971,551 B2 * 12/2005 Widgery ..... A47G 19/2266 222/129
7,461,987 B2 * 12/2008 Liechty ..... A45D 34/042 222/129
7,665,631 B2 * 2/2010 Pikowski ..... A47G 19/183 222/129
7,934,624 B2 * 5/2011 Seelhofer ..... B65D 81/3227 215/6
8,021,342 B2 * 9/2011 Girgis ..... A61J 7/0053 222/129
2006/0175330 A1 * 8/2006 Richardson ..... B65D 47/06 220/212
2007/0045342 A1 * 3/2007 Pigliacampo ..... A45F 3/20 222/129
2007/0080170 A1 * 4/2007 Saha ..... A47G 19/24 222/142.1
2009/0134110 A1 * 5/2009 Jones ..... B65D 81/3227 215/6
2015/0008241 A1 * 1/2015 Kenworthy ..... B65D 1/04 222/144.5
2016/0311602 A1 * 10/2016 Brace ..... B65D 35/22

* cited by examiner

DISPENSING DEVICE FOR A DRINK BASED ON ONE FLUID AND/OR A SECOND FLUID

CROSS-REFERENCE TO RELATED APPLICATION

The present application claims priority to French Patent Application No. FR-1558252, filed Sep. 7, 2015. The priority application, FR-1558252, is hereby incorporated by reference.

FIELD OF THE DISCLOSURE

The invention concerns a device for dispensing a drink based on one fluid to which a second fluid can be added selectively.

BACKGROUND

To do this, the device includes a support equipped with a chamber for dispensing the drink, said chamber having a first port intended to communicate with a reservoir for a first fluid, for example water, a second port intended to communicate with a reservoir for a second fluid, for example an energy and/or flavoring additive, and an outlet port for the drink based on the first and/or second fluid(s).

Devices of this kind are known, in particular from EP-1 948 531, where the support is arranged to be mounted in the opening at the top of a main water reservoir, and to which an additional additive reservoir can be connected, said additional reservoir being arranged in said main reservoir when said device is mounted on said main reservoir, in order to form a container for dispensing the drink.

Containers of this kind are especially suitable for use in open-air activities such as hiking, running or cycling for transporting water and an additive to add to said water to form an energy and/or flavored drink, said water and said additive being held separately in their respective reservoirs and mixed at the time of dispensing to form said drink.

To enable the drink to be dispensed, it is known to equip a device of this kind with a dispensing assembly mounted moveably relative to the support after a first displacement, arranged to open and close the outlet port and/or the first feed port for the first fluid and/or after a second displacement, arranged to selectively open and close the second feed port for the second fluid.

In particular, the dispensing assembly can also be movable following a third displacement, in order to control the size of the opening of the second port, thereby enabling the quantity of the second fluid to be added to the first fluid to be adjusted.

For example, U.S. Pat. No. 3,850,346 describes a dispensing device for a diluting agent and/or an additive, in which the dispensing assembly is threaded for screwing in place but mounted moveably relative to the support after three consecutive displacements of the same kind of motion in order to allow successively the opening of the first port for the diluting agent, then the opening of the second port for the additive, and then the adjustment of the size of the opening of said second port.

SUMMARY OF THE DISCLOSURE

The aim of the invention is to perfect the prior art by proposing in particular a dispensing device for a drink for which the type of actuating motion is particularly simple and intuitive.

To do this, the invention proposes a dispensing device for a drink based on a first fluid to which a second fluid can be added selectively, said device comprising a support containing a dispensing chamber having a first port communicating with a reservoir of said first fluid, a second port communicating with a reservoir of said second fluid, and a outlet port for said first and/or second fluids, said device comprising a dispensing assembly mounted movably relative to said support following:

- a first displacement arranged to open and close said outlet port and/or the first port selectively, said device including a first actuating element for said first displacement, and
- a second displacement arranged to open and close said second port selectively, said device comprising a second element to enable the actuation of said second displacement;

the second element being arranged to be actuated after the first element has been actuated and following a motion of a type different to the motion necessary to actuate said first element.

BRIEF DESCRIPTION OF THE SEVERAL VIEWS OF THE DRAWINGS

Other features and advantages of the invention will appear in the description below with reference to the Figures in the Annex, in which.

DETAILED DESCRIPTION OF THE PREFERRED EMBODIMENTS

Figure 1A:
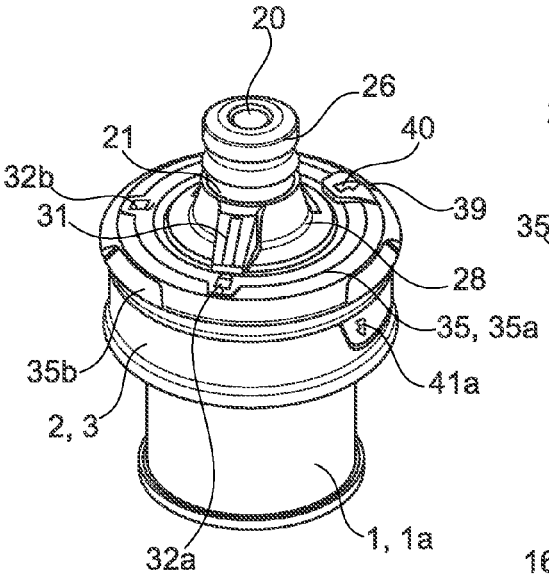
FIG. 1*a* is a perspective view of a dispensing device according to an embodiment of the invention, with a connection to a reservoir for the second fluid.

With reference to these Figures, a dispensing device is described below for a drink based on a first fluid, for example water, to which a second fluid, such as an energy and/or flavor additive, for example, can be added.

In particular, the device is arranged to be mounted in the opening at the top of a main water reservoir (not shown) and to allow an additional additive reservoir 1 to be connected to it, said additional reservoir also being arranged in said main reservoir when said device is fitted on said main reservoir in order to form a container for dispensing the drink.

A container of this kind is especially suitable for use in open-air activities such as hiking, running or cycling, in order to transport water and an additive to add to said water to form an energy and/or flavored drink, said water and said additive being held separately in their respective reservoirs and mixed at the time of dispensing to form said drink.

To do this, the dispensing device consists of a support arranged so as to allow said device to be mounted on a main water reservoir, and to allow a connection on it for an additional reservoir 1 for the additive.

The support consists of an outer cover 2 arranged to enable the fitting of a dispensing device on the upper opening at the top of such a main reservoir. To this end, the outer cover 2 includes an axial peripheral skirt 3 threaded on the inside 3*a* to allow it to be screwed on to the threaded neck of the main reservoir, in which a top opening is formed giving access to a first fluid held in said main reservoir.

Furthermore, the support includes an inner part 4 arranged to allow the connection of the additional reservoir 1 holding the second fluid. To this end, the inner part 4 includes a central tubular piece 5 with a lower sleeve 5*a* on the inside of which the upper neck 6 of the additional reservoir 1 is intended to be fitted, for example by a thread or a click and lock mechanism.

In addition, the inner part 4 includes a platform 7 which extends radially around the central tubular piece 5 and is fastened in the peripheral skirt 3 of the outer cover 2, in particular above the thread for screwing in the main reservoir. Furthermore, a seal can be fitted between the thread and the fastening zone of the platform 7 in order to ensure the leak-tightness of the device when mounted on the main reservoir.

In particular, the main reservoir can include a flexible peripheral wall that by means of compression of said wall allows the first fluid held in said main reservoir to be pressurized, and therefore to be distributed by means of the device mounted on said main reservoir. In addition, the platform 7 includes a recess 46, in an upper wall of which orifices 47 formed to allow air to enter the main reservoir at the end of dispensing, said recess being capable of being fitted with a valve to regulate said entry of air.

Furthermore, as shown in the Figures, the additional reservoir 1 consists of a peripheral cylindrical wall 1*a*, the lower opening of which is blocked by a piston 8, said piston being intended, when the drink is being dispensed, to slide axially in said additional reservoir under the effect of the pressure exerted by the first fluid from the main reservoir, in order to allow the simultaneous dispensing of said second fluid with said first fluid.

With reference to the Figures, the central tubular piece 5 includes an upper sleeve 5*b* on the periphery of which a number of orifices 9 are formed which lead into the first reservoir, thus constituting a passage for the first fluid. For example, the upper sleeve 5*b* can include three orifices 9 distributed at equal angles around its periphery as passages for the first fluid.

In particular, the outer cover 2 includes an upper platform 10, from the outer edge of which the peripheral skirt 3 extends, said platform including a central opening 11 into which the upper sleeve 5*b* extends axially. Furthermore, to reinforce the fastening of the inner part 4 to the outer cover 2, the upper sleeve 5*b* includes a projection 12 which engages in a recess 11*a* in the central opening 11.

The dispensing device includes a tubular insert 13 containing an axial passage 14 which opens at the top into a passage 15, formed in the periphery of said insert, for the second fluid. With reference to the Figures, the insert 13 has a bottom end 16 mounted on the lower sleeve, connecting the passage of the second fluid 15 with the additional reservoir 1.

Figure 6A:
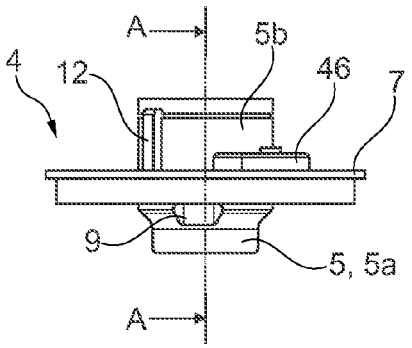
FIG. 6*a* is a front elevation view of the internal part of the support for the dispensing device in FIGS. 1*a* through 5*c;*
Figure 6B:
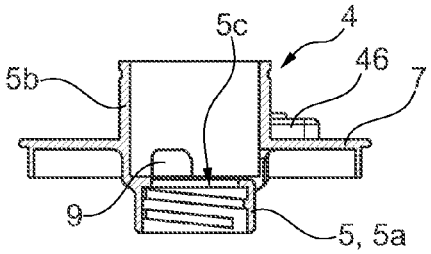
FIG. 6*b* is a longitudinal cross-section taken along the plane A-A of FIG. 6*a;*
Figure 6C:
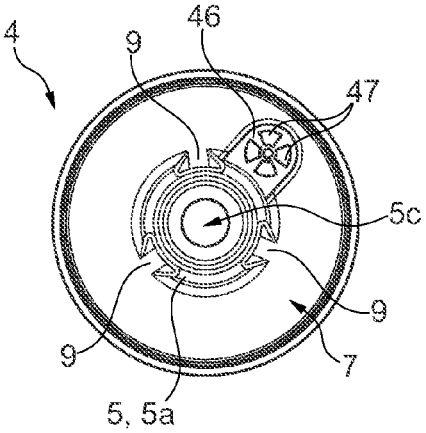
FIG. 6*c* is a top view of the internal part shown in FIG. 6*a;*
Figure 6D:
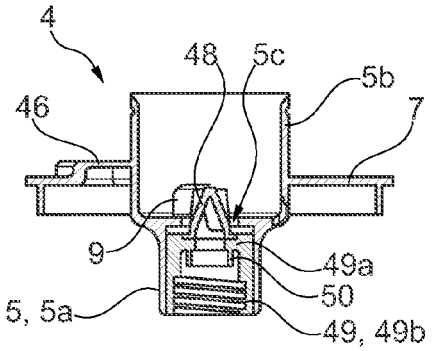
FIG. 6*d* is a longitudinal cross-section through a variant of the internal part.

In particular, as shown in FIGS. 6*b* and 6*d*, the central tubular part 5 includes a central passage 5*c* which extends between the upper sleeve 5*b* and the lower sleeve 5*a* and connects the two initially, in particular before the assembly of the device. Furthermore, the bottom end 16 of the insert 13 is arranged to be mounted leak-tight in the central passage 5*c* during assembly of the dispensing device, particularly to avoid any backflow through said central passage of the first fluid moving in the upper sleeve 5*b* into the additional reservoir 1 of the second fluid.

Figure 9A:
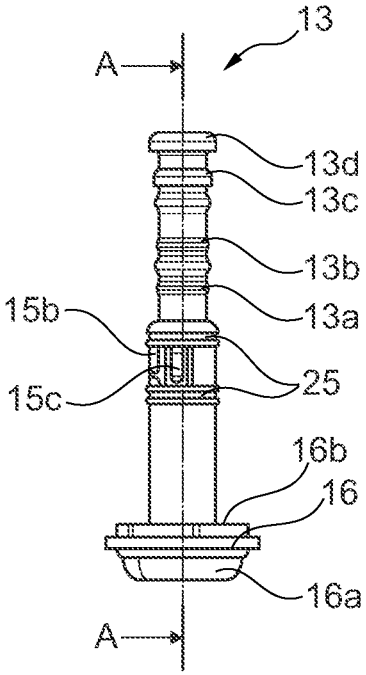
FIG. 9*a* is a side elevation view of the insert of the dispensing device in FIGS. 1*a* to 5*c;*
Figure 9B:
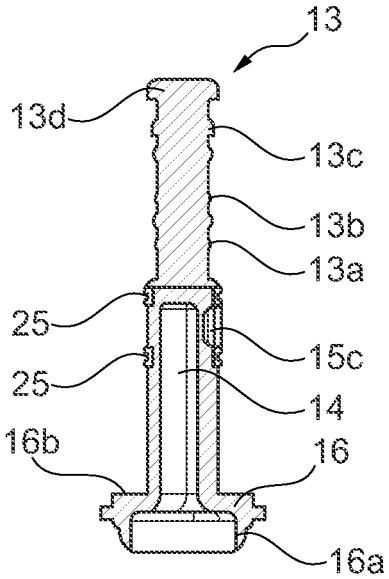
FIG. 9*b* is a longitudinal cross-section, taken along the plane A-A of FIG. 9*a;*
Figure 9C:
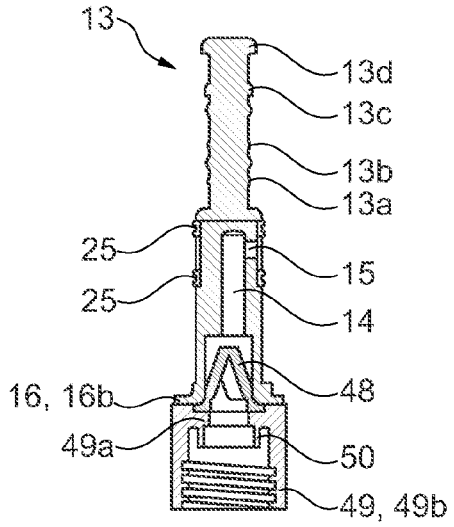
FIG. 9*c* shows a longitudinal section through a variant of the insert.
Figure 10A:
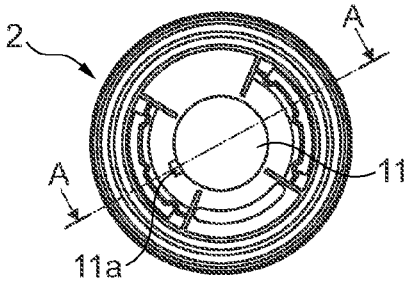
FIG. 10*a* is a bottom view of the outer cover of the support of the dispensing device in FIGS. 1*a* to 5*c;*
Figure 10B:
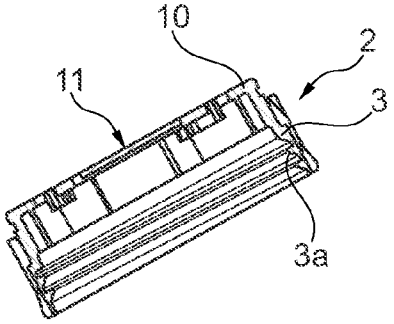
FIG. 10*b* is a longitudinal cross-section, taken along the plane A-A of FIG. 10*a;*

In the embodiment shown in FIGS. 6*d* and 9*c*, the dispensing device includes a non-return valve 48 arranged upstream of the axial passage 14 in order to close the connection between said passage and the additional reservoir 1, thereby preventing any backflow of undispensed drink through said passage into said additional reservoir.

In particular, the device includes a stopper 49 which is mounted, for example by a press fit, in the lower sleeve 5*a* and which includes an upper part 49*a* upon which the valve 48 is mounted in such a way as to extend through the central passage 5*c* into the bottom end 16. Furthermore, the stopper 49 has a lower part 49*b* which extends axially into the lower sleeve 5*a*, and in the inside of which the upper neck 6 of the additional reservoir 1 is intended to be fitted, for example by a thread or a click and lock mechanism.

According to one embodiment, the second fluid can be held in the additional reservoir 1 directly in a liquid form, and the upper neck of said additional reservoir can be blocked temporarily by a breakable film intended to be broken by the introduction of said neck into the lower sleeve 5*a* in order to allow the second fluid to be dispensed.

To do this, with reference to FIGS. 1*a*, 1*b*, 3*a*, 3*b*, 3*c*, 9*a* and 9*b*, the bottom end 16 of the tubular insert 13 includes a lower skirt 16*a* which extends axially into the lower sleeve 5*a*, said sleeve having a pointed bottom end for puncturing the breakable film when the connection is made between the additional reservoir 1 and said lower sleeve.

Similarly, with reference to FIGS. 6*d* and 9*c*, the stopper 49 has a lower skirt 50 which extends axially under the upper part 49*a* and which has a pointed bottom end for puncturing such a breakable film.

In one variant, the second fluid can be held in a breakable capsule which is introduced into the additional reservoir 1 before said additional reservoir and the dispensing device are assembled together on the main reservoir, said breakable capsule being penetrated by the effect of the pressure exerted on it by the piston 8 the first time a drink is dispensed.

The support is also fitted with a dispensing chamber 17, with a first port 18 arranged to communicate with the main reservoir for the first fluid, and a second port 19 arranged to communicate with the additional reservoir 1 for the second fluid, and an outlet port 20 for said first and/or second fluid(s).

Furthermore, the dispensing device also includes a dispensing assembly which is mounted movably relative to the support following:

- a first displacement, arranged to selectively open and close the outlet port 20 and/or the first port 18;
- and a second displacement arranged to selectively open and close the second port 19.

With reference to the Figures, the dispensing assembly includes an end piece 21 in which are formed the dispensing chamber 17, the first port 18, the second port 19 and the outlet port 20, said end piece being mounted on the upper sleeve 5*b* and arranged around the insert 13.

The end piece 21 is mounted moveably in relation to the upper sleeve 5*b* following the first displacement to selectively open and close the communication between the first port 18 and the passage for the first fluid 9 formed in said upper sleeve.

To achieve this, the end piece 21 includes a bottom end on which is formed the first port 18, said end piece being movable upwards following its first displacement between a first bottom position, in which said bottom end is arranged in tight contact against the base of the upper sleeve 5*b* in order to prevent communication between the first port 18 and the passage for the first fluid 9, and a first top position in which said bottom end is arranged at a distance from said base to allow said communication.

In particular, the bottom end 16 of the insert 13 includes an upper surface 16*b* which extends into the base of the upper sleeve 5*b* and which can be provided, for example by a molding, with a coating to ensure the leak-tightness of the contact between said base and the bottom end of the end piece 21 in the first closed position.

The bottom end of the end piece 21 is fitted with a piston 22 which slides in a leak-tight manner inside the upper sleeve 5*b* and which is arranged to be arranged facing, or respectively at a distance from, the passage 9 for the first fluid in the first closed or opened position respectively.

As an advantage, the piston 22 includes sealing lips 23 facing the first port 18 which are arranged to open or respectively close said first port by means of pressure exerted on them by the first fluid coming from the passage 9 for the first fluid, or from the drink contained in the dispensing chamber 17 respectively. In this way, when the drink is dispensed, the sealing lips 23 form a non-return valve arranged to close the communication between the first port 18 and the passage for the first fluid 9, thereby preventing any backflow through said drink passage from said chamber into the main reservoir of the first fluid.

Similarly, following the second displacement the end piece 21 is mounted movably in relation to the insert 13 to open and close selectively the communication between the second port 19 and the passage of the second fluid formed in said insert.

To do this, the end piece 21 includes an inner tubular portion 24 which extends axially inside the dispensing chamber 17 and around the insert 13, and on the periphery of which the second port 19 is formed. In particular, following the second displacement, the end piece 21 is movable in upwards translation between a second bottom position, in which the second port 19 is arranged axially at a distance from the passage for the second fluid 15 in order to prevent communication between said second port and said passage for the second fluid, and a second top position, in which said second port is arranged facing said passage for the second fluid such as to allow said communication.

Advantageously, the insert 13 is provided, in particular by molding, with a leak-tight coating 25, at least at the zone of its periphery which surrounds the passage for the second fluid 15, said coating ensuring a tight closure of said passage coming into contact with the inner tubular portion 24 when said passage is not arranged facing the second port 19.

In the embodiments shown, the end piece 21 is movable in translation following an axial path forming the first and second displacements successively, and in particular between:

- a bottom position (corresponding to the bottom position of the first movement) in which the first 18 and second 19 ports are both closed, in order to close the dispensing device totally;
- an intermediate position (corresponding simultaneously to the top position of the first displacement and the bottom position of the second displacement), in which the first port 18 is open and the second port 19 is closed, in order to allow the dispensing of a drink containing the first fluid only; and
- a top position (corresponding to the top position of the second movement), in which the first 18 and second 19 ports are both open, in order to allow the dispensing of a beverage consisting of both the first fluid and the second fluid.

The insert 13 has three radial projections formed on its periphery, in particular a bottom projection 13*a*, an intermediate projection 13*b* and a top projection 13*c*, the top end 24*a* of the tubular part 24 abutting one of said projections when the end piece is arranged respectively in the bottom position for closing the device, in the intermediate position for dispensing the first fluid, and the top position for dispensing the first and the second fluids.

In particular, the upper projection 13*c* is arranged, in particular by having a radial dimension greater than the lower 13*a* and intermediate 13*b* projections, to form a stop at the end of the travel of the end piece 21, in order to retain said end piece axially on the insert 13, and therefore on the support of the dispensing device.

In addition, the outlet port 20 is selectively opened and closed by the insert 13 when the end piece 21 moves following the first displacement. With reference to the Figures, the end piece 21 includes a nipple 26 which is secured by a press fit at the top end and which has an outlet duct 27 for the drink supplied to the lower part by the dispensing chamber 17 and opening at the top into an orifice forming the outlet port 20 for the drink.

Furthermore, the top end 13*d* of the insert 13 is arranged to be selectively arranged in—respectively clear of—the lower part of the outlet duct 27 when the translational displacements of the end piece 21 following its first displacement, in order to selectively close—respectively open—the communication between the dispensing chamber and the outlet port 20.

Therefore, when the end piece 21 is in its bottom position, the device is also closed at the level of its outlet port 20, which enables the risks of contamination of said dispensing chamber 17, notably by external dirt and/or by ambient air, when the device is not being used, to be limited. In addition, the nipple 26 can be fitted with a cap (not shown) which is mounted reversibly on said nipple when the end piece 21 is in the bottom closed position, in order to be able to cover said nipple when not in use with a view to protecting it particularly against dirt contamination.

To be able to move the end piece 21, the dispensing device includes a first and second element to respectively actuate the first displacement and enable the actuation of the second displacement of said end piece.

In particular, the second element is arranged to be actuated after the actuation of the first element and following a type of motion which is different to the motion necessary to actuate said first element. The dispensing device can therefore be actuated in accordance with a particularly intuitive type of displacement in order to allow the user to obtain easily a drink based on the first fluid and/or the second fluid, depending on his taste and/or energy requirements.

In the embodiments shown, the second actuating element is arranged to allow the second displacement to be actuated directly. In one variant, the second element can be arranged to allow this actuation indirectly, for example by bringing about, when it is actuated, the unblocking of a third actuating element for the second displacement.

In particular, the end piece 21 can be arranged to form simultaneously the first and the third actuating elements of its first and second displacements, notably by being movable by being pulled manually twice in succession. Moreover, the second element can be arranged to block the translation of the end piece 21 on the intermediate position at the end of the first displacement, the user actuating said second organ to unblock said end piece and thereby allow the second displacement by pulling manually on said end piece.

Similarly, the second element can be arranged to block the translational displacement of the end piece 21 into its intermediate position at the end of the opposite actuation of the second displacement, in other words after manual pressure on said end piece to close the port 19, the user actuates said second element again to unblock said end piece, thereby allowing the opposite actuation of the first displacement to close the first port 18 and/or the outlet port 20.

Figure 8A:
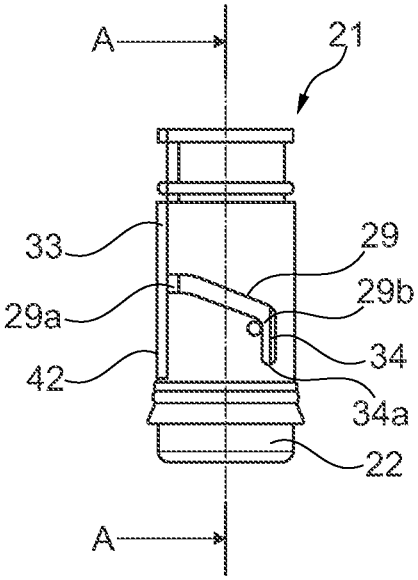
FIG. 8*a* is a side elevation view of the end piece of the dispensing device in FIGS. 1*a* to 5*c;*
Figure 8B:
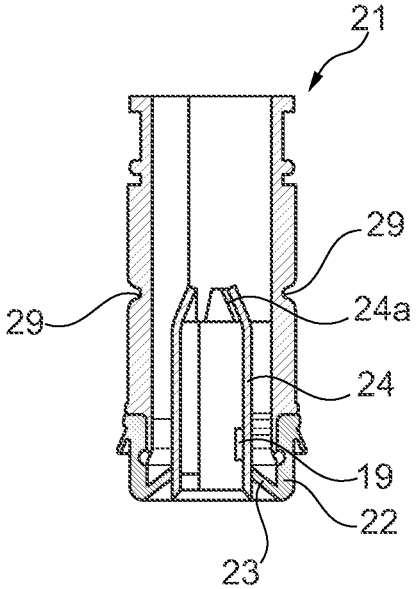
FIG. 8*b* is a longitudinal cross-section of the end piece of FIG. 8*a*, taken along the plane A-A of FIG. 8*a;*

With reference to the Figures, the first actuating element consists of a ring 28 mounted so that it can rotate around the end piece 21 to drive said end piece in translation on its first displacement. To do this, as shown in FIGS. 1*b* and 8*a*, the end piece includes two axial-radial grooves 29 each formed in one part of its periphery, and which are diametrically opposite each other.

Figure 1B:
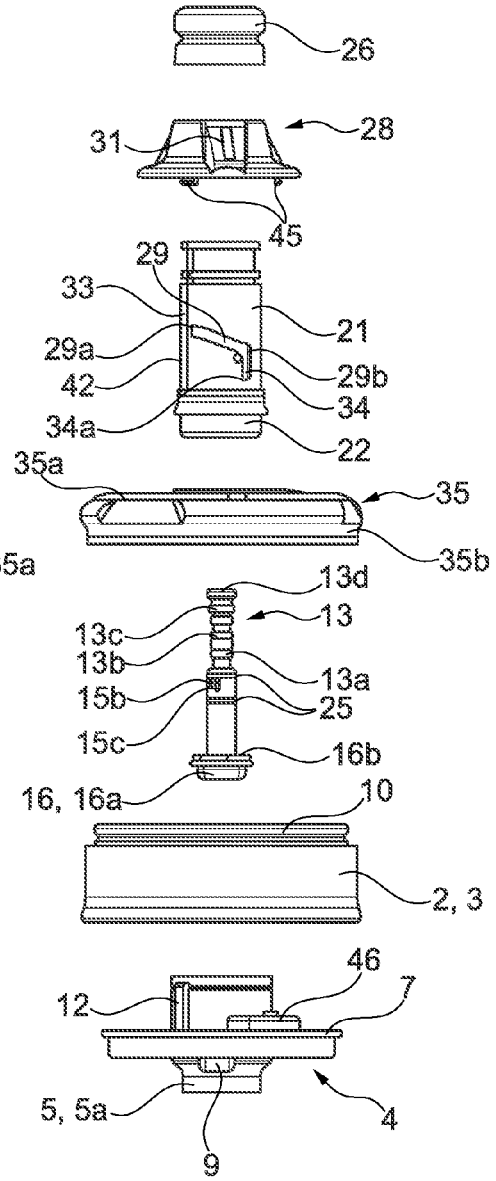
FIG. 1*b* is an exploded side elevation view of the dispensing device of FIG. 1.
Figure 2A:
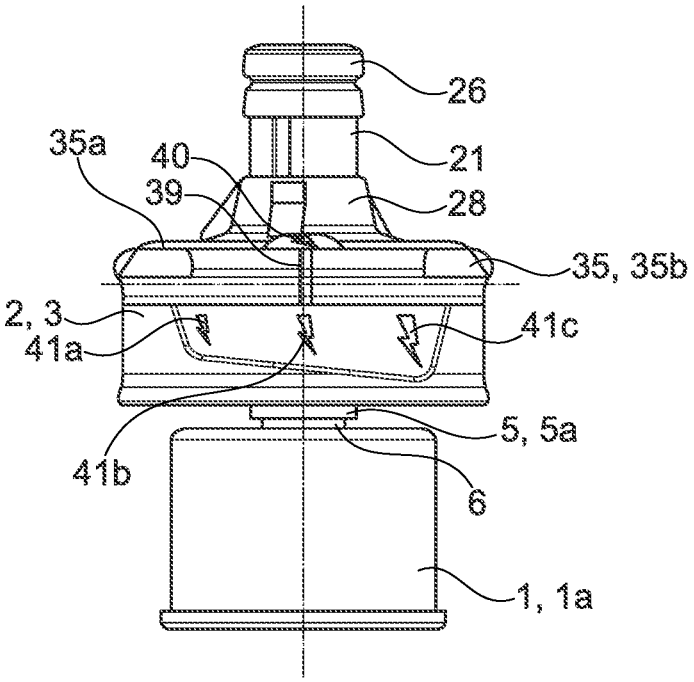
FIG. 2*a* is a side elevation view of the dispensing device in FIG. 1*a*, with the second port in its intermediate open position.
Figure 2B:
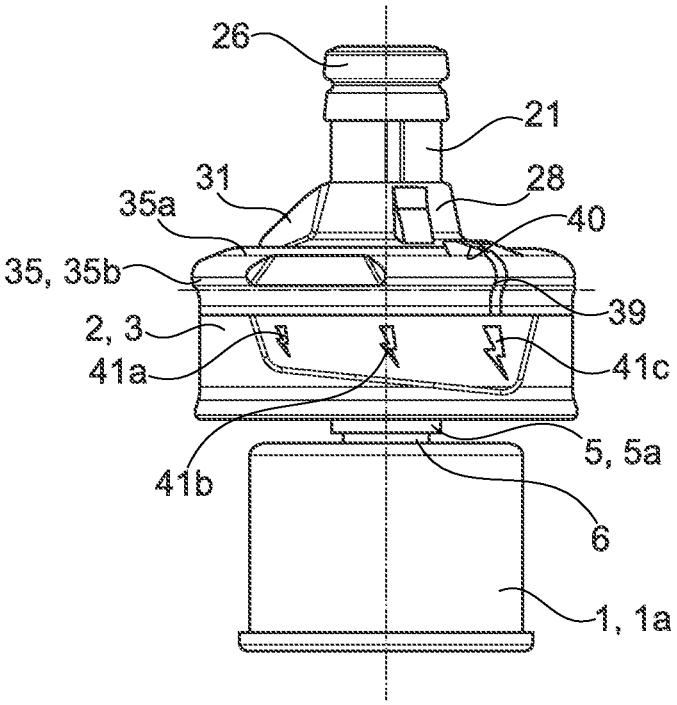
FIG. 2*b* is a side elevation view of the dispensing device in FIG. 1*a*, with the second port in its fully open position.
Figure 3A:
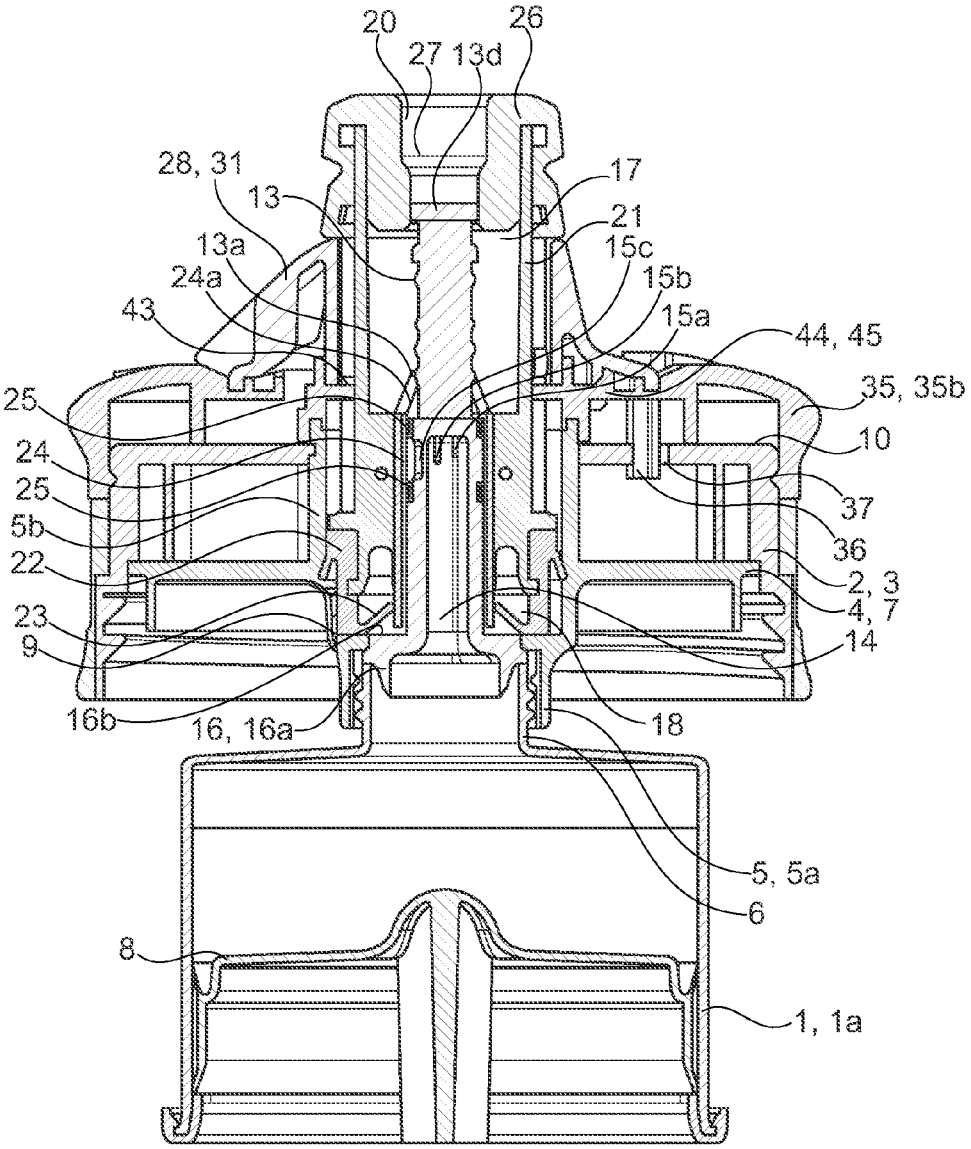
FIG. 3*a* is a longitudinal section through the dispensing device in FIGS. 1*a*, 1*b* and 2*a*, 2*b*, with the first and second ports and the outlet port in their closed positions.
Figure 3B:
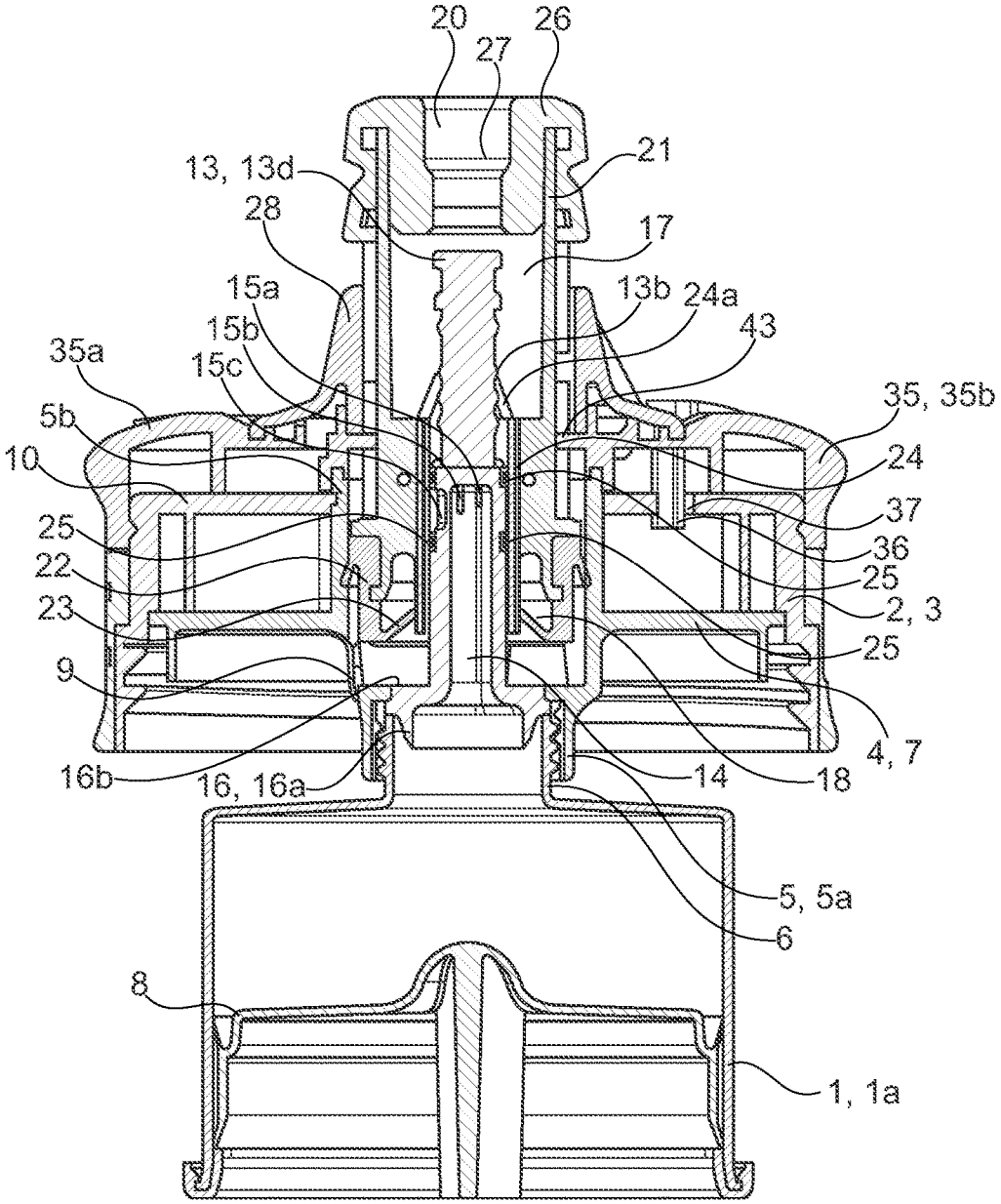
FIG. 3*b* is a longitudinal section through the dispensing device in FIGS. 1*a*, 1*b* and 2*a*, 2*b*, with the first port and the outlet port in their open positions and the second port in its closed position
Figure 3C:
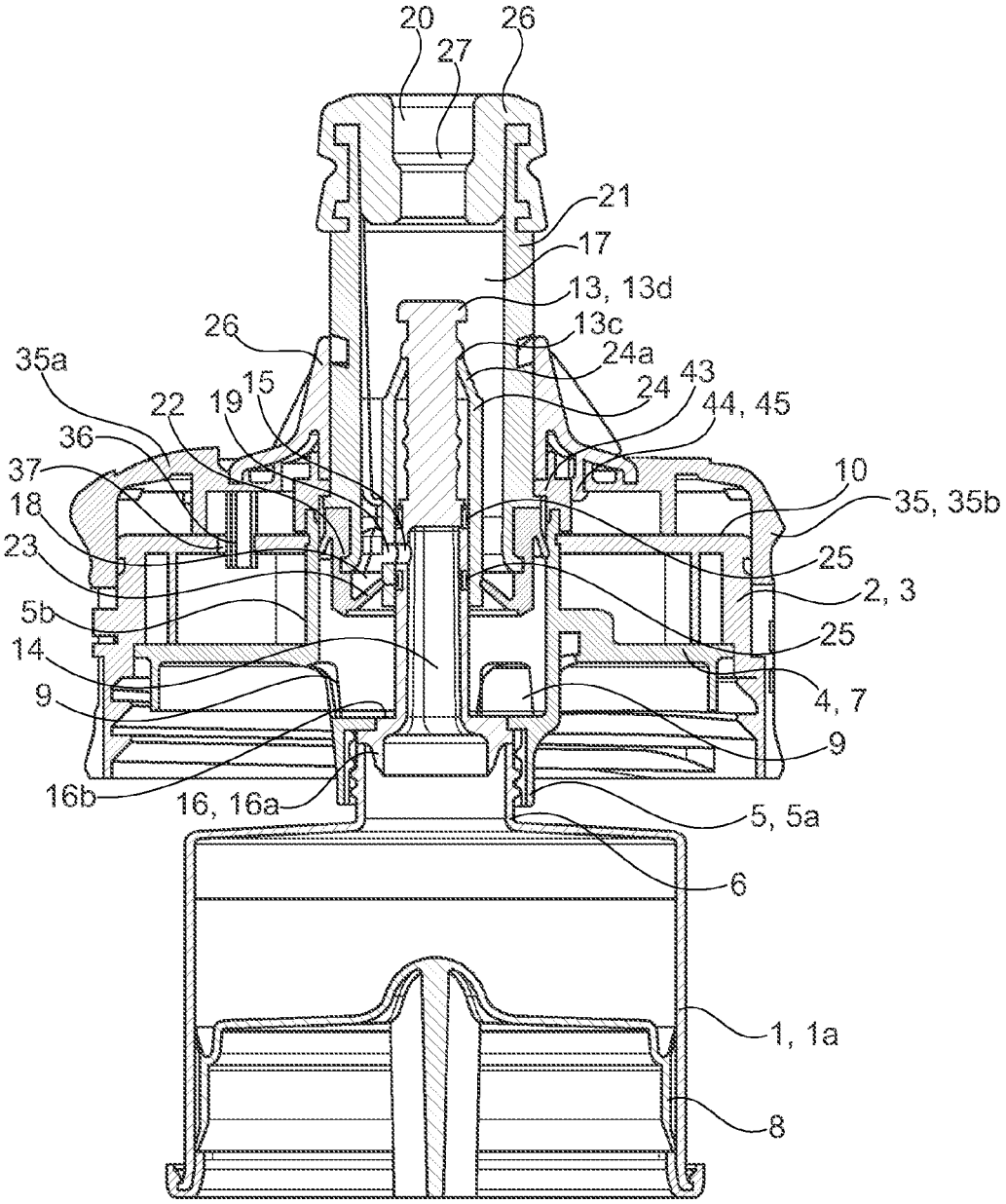
FIG. 3*c* is a longitudinal section through the dispensing device in FIGS. 1*a*, 1*b* and 2*a*, 2*b*, with the first and second ports and the outlet port in their open positions.
Figure 7A:
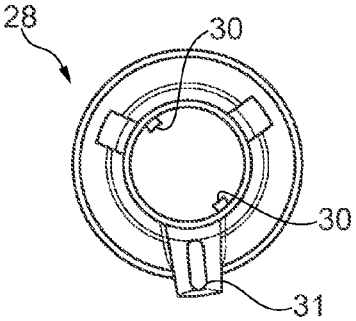
FIG. 7*a* is a plan view of the first actuating element of the dispensing device in FIGS. 1*a* to 5*c;*
Figure 7B:
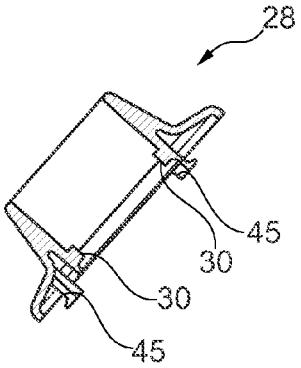
FIG. 7*b* is a longitudinal section of the first actuating element of the dispensing device in FIGS. 1*a* to 5*c;*

Moreover, as shown in FIGS. 1*b*, 7*a* and 7*b*, the ring 28 includes two bosses 30 diametrically opposite each other which slide in each axial radial groove 29 when said ring rotates following the first actuation, taking an angled path corresponding to the first translational displacement of the end piece 21.

In particular, each axial radial groove 29 has a top end 29*a* and a bottom end 29*b* in which the boss 30 is positioned when the end piece 21 is in the bottom closed position of the device and the intermediate position for dispensing the first fluid respectively.

Figure 4A:
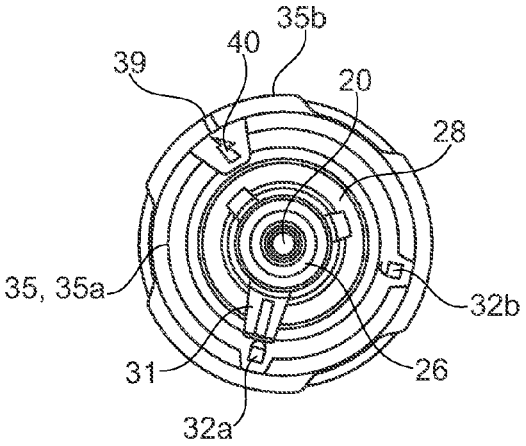
FIG. 4*a* is a plan view of the device in FIGS. 1*a* through 3*c*, with the first port and the outlet port in their open positions.
Figure 4B:
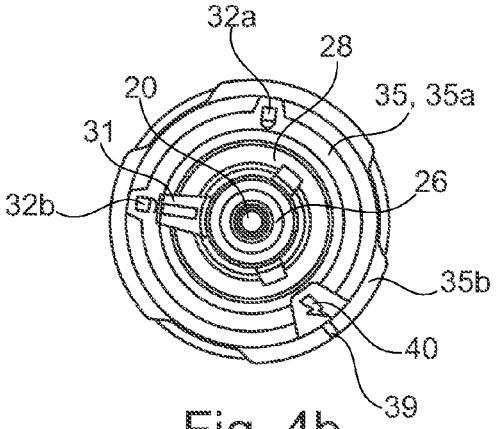
FIG. 4*b* is a plan view of the device in FIGS. 1*a* through 3*c*, with the first port and the outlet port in closed positions.

Moreover, the ring 28 includes a radial outer lug 31 that the user can grip manually to actuate said ring in rotation, said lug being arranged selectively facing a visual indicator 32*a*, 32*b*, for example in the form of a drawing showing a closed padlock 32*a* (FIG. 4*a*) and an open padlock 32*b* (FIGS. 1*a*, 4*b*) when the end piece 21 is respectively in the bottom and intermediate positions, in order to indicate to the user whether the first port 18 is open or closed.

The end piece 21 also includes two upper axial grooves 33 which each extend from the top end 29*a* of an axial-radial groove 29, the bosses 30 each being positioned in one of said upper axial grooves when the ring 28 is assembled on the end piece 21 in order to facilitate their positioning in said axial-radial grooves.

In the embodiment shown, the end piece 21 forms the actuating element, and can be moved manually in translation, in particular by pressure and/or pulling axially on the nipple 26 on its second displacement. With reference to FIGS. 1*b* and 8*a*, the end piece 21 includes two lower axial grooves 34 which each extend from the bottom end 29*b* of an axial-radial groove 29 and in which the corresponding boss 30 of the ring 28 slides along an axial path corresponding to the second displacement of said end piece.

In particular, each lower axial groove 34 has a bottom end 34*a* in which the boss 30 is positioned when the end piece 21 is in the top position for dispensing the first fluid and the second fluid.

The end piece 21 is also mounted movably in relation to the support after a third displacement which is arranged to control the size of the opening of the second port 19, in order to allow the quantity of the second fluid to be added to the first fluid to be adjusted, in particularly according to the taste and/or energy requirements of the user.

To do this, the insert 13 has several passages 15*a*-15*c* of different sizes which are aligned radially in a peripheral zone, the end piece 21 being movable in rotation after its third displacement to position said passages selectively in communication with the second port 19.

Figure 5A:
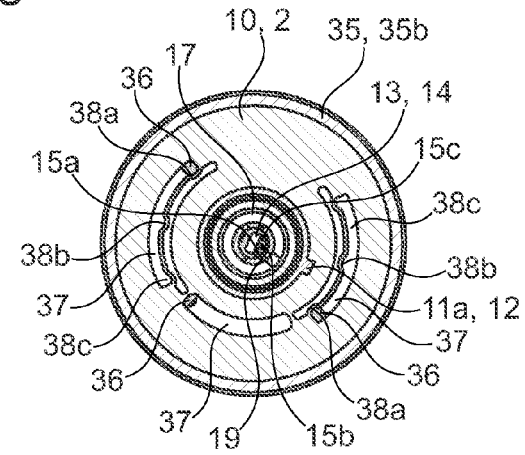
FIG. 5*a* is a lateral cross-section view through the device in FIGS. 1*a* through 4*b*, with the second port in its minimum open position.
Figure 5B:
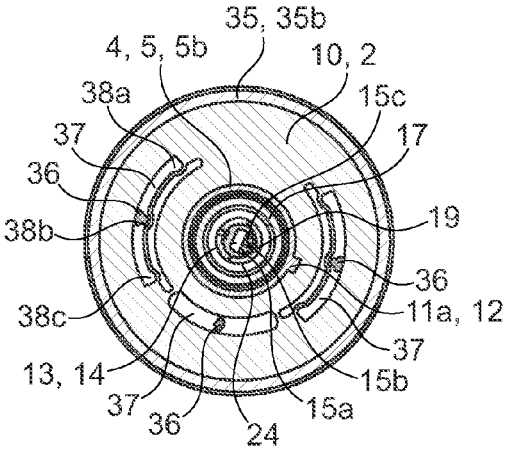
FIG. 5*b* is a lateral cross-section view through the device in FIGS. 1*a* through 4*b*, with the second port in an intermediate open position.
Figure 5C:
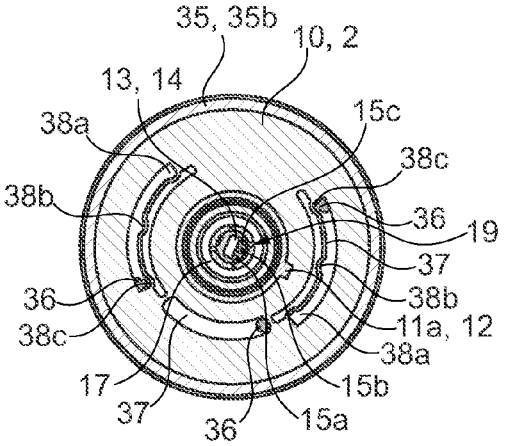
FIG. 5*c* is a lateral cross-section view through the device in FIGS. 1*a* through 4*b*, with the second port in a maximum open position.

In particular, the insert 13 includes three successive passages 15*a*-15*c*, notably one small passage 15*a*, one medium-sized passage 15*b*, and one large passage 15*c*, the second port 19 being arranged selectively facing radially each of said passages to be opened with an opening size which is respectively minimum (FIG. 5*a*), medium (FIG. 5*b*) or maximum (FIG. 5*c*).

Furthermore, the dispensing device includes a third actuating element for the third displacement, said third element being arranged to be actuated in a type of motion which is different to the type of motion necessary for the second element, and which gives said element a particularly simple and intuitive functioning.

With reference to the Figures, the third actuation comprises a disc 35 which is mounted in rotation on the platform 10 of the outer cover 2 and which is arranged to drive the end piece 21 in rotation on its third displacement. The disc 35 comprises an upper platform 35*a* which extends radially around the end piece 21, and a peripheral skirt 35*b* which is secured by a click and lock mechanism on an upper part of the peripheral skirt 3 of the cover 2.

In particular, the disc comprises three lugs 36 to index the radial position of the second port 19, said lugs each extending axially under the upper platform 35*a* of said disc. Similarly, the platform 10 of the cover 2 includes three radial slots 37 in each of which one indexing lug 36 slides.

With reference to FIGS. 5*a*-5*c*, at least two radial slots 37 have recesses 38*a*-38*c* for indexing the passages 15*a*-15*c* of the second fluid, which are respectively formed at each end of said slot and midway between said ends, the indexing lugs 36 being arranged respectively in a recess 38*a*-38*c* when the second port 19 is radially facing the small passage 15*a* (FIG. 5*a*), the intermediate passage 15*b* (FIG. 5*b*) and the large passage 15*c* (FIG. 5*c*).

Advantageously, the indexing lugs 36 and/or recesses 38*a*-38*c* can be arranged such that the positioning of said lugs in said recesses takes place with a characteristic noise in order to indicate to the user that the second port 19 has been correctly positioned facing the desired passage 15*a*-15*c*, corresponding to the desired quantity of the second fluid to be dispensed.

Furthermore, the disc 35 includes at least one visual indicator, in particular a recess 39 and/or a drawing in the form of a lightning flash 40, which is formed on the peripheral skirt 3 and/or on the upper platform 35*a* for indicating the radial position of the second port 19. Similarly, the outer cover 2 includes at least three visual indicators, in particular three drawings 41*a*-41*c* in the form of lightning flashes of different sizes, which are formed on the peripheral skirt 3 to indicate the positions of each indexing recess 38*a*-38*c* of a slot 37, and therefore indirectly the positions of each of the passages 15*a*-15*c* of the second fluid.

In this way, the user wanting to control the size of the opening of the second port 19 simply rotates the disc 35 in such a way as to position the visual indicator 39, 40 of said disc so that it faces the visual indicator 41*a*-41*c* of the cover 2 corresponding to the desired size of opening for the second port 19 and therefore the desired quantity to be dispensed of the second fluid.

In one particularly advantageous way, the dispensing assembly is mounted such that the first and/or second displacements can be implemented independently of the third displacement, in order to allow the user to keep the desired control setting for the quantity of the second fluid to be dispensed, regardless of the open or closed status of the first 18 and second 19 ports.

To do this, as shown in FIGS. 1*b* and 8*a*, the end piece 21 includes two lower axial grooves 42 which each extend from the upper end 29*a* of one axial-radial groove 29, and in particular in the extension respectively of an upper axial groove 33 for positioning the bosses 30 in said axial-radial grooves.

Similarly, the disc 35 includes two bosses diametrically opposite each other which are mounted so that they can each slide in a respective axial groove 42, 43, in order to allow the disc 35 to rotate locked with the end piece 21 regardless of the axial position of said end piece, and conversely to allow the first and second translational displacements of said end piece regardless of its radial position, Furthermore, the ring 28 is mounted in rotation after the first actuation on the disc 35, in order to be driven in rotation together with the end piece 21 at the time of its third displacement and to be able to be actuated independently of the position of said disc to allow the selective opening and closing of the first port 18 and the outlet port 20. To do this, the disc 35 includes two radial slots 44 which are formed on the platform 35*a* being diametrically opposite each other, the ring 28 comprising two spigots 45 which each slide in a first radial slot 44 in an angular path corresponding to the first displacement.

Figure 11A:
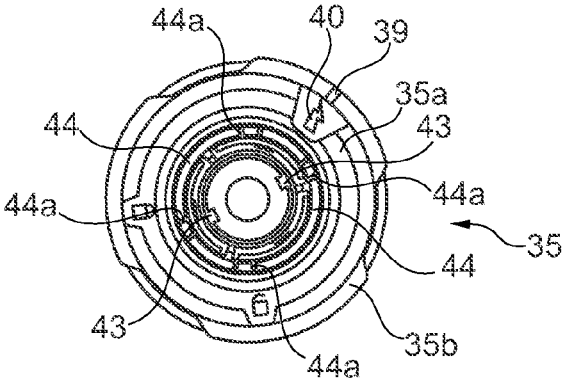
FIG. 11*a* is a top view of the third actuating element of the dispensing device shown in FIGS. 1*a* to 5*c*.
Figure 11B:
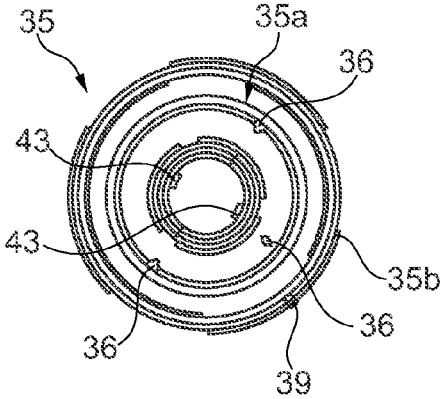
FIG. 11*b* is a bottom view of the third actuating element of the dispensing device shown in FIGS. 1*a* to 5*c*.

In particular, with reference to FIG. 11*a*, each radial slot 44 of the disc 35 comprises two ends 44*a* against which the spigots 45 abut radially in one of the closing and opening positions of the first port 18 and the outlet port 20 respectively. In addition, the visual indicators 32*a*, 32*b* of these positions are formed on the platform 35*a* of the disc 35, the actuating lug 31 of the ring 28 being positioned facing one indicator 32*a*, 32*b* respectively depending on the closing or opening status of the first port 18 and the outlet port 20.

We claim:

1. A dispensing device for a drink based on a first fluid to which a second fluid can be added selectively, said device comprising:

a support containing a dispensing chamber having a first port communicating with a reservoir of said first fluid, a second port communicating with a reservoir of said second fluid, and an outlet port for said first and/or second fluids, and a dispensing assembly mounted movably relative to said support following:

a first displacement arranged to open and close said outlet port and/or the first port selectively, said device including a first actuating element for said first displacement, and a second displacement arranged to open and close said second port selectively, said device comprising a second actuating element to enable the actuation of said second displacement;

the second actuating element being arranged to be actuated, after the actuation of the first element and following a type of motion which is different to the motion necessary to actuate said first element, the support having a first fluid passage for the first fluid, the dispensing assembly including an end piece in which the dispensing chamber is formed, said end piece being movable relative to said passage following the first displacement so as to selectively open and close the communication between the first port and said first fluid passage, and further including an insert in which a second fluid passage is formed for the second fluid, the end piece being movable relative to said insert following the second displacement so as to selectively open and close the communication between said second port and said second fluid passage.

2. The dispensing device according to claim 1, the first and second actuating elements being arranged to drive the dispensing assembly successively after the first and second displacements of the dispensing assembly.

3. The dispensing device according to claim 2, one of the first or the second actuating element being movable in rotation to drive the dispensing assembly after one of the first or second displacement of the dispensing assembly.

4. The dispensing device according to claim 1, the dispensing assembly being mounted movably in relation to the support following a third displacement, which is arranged to control the size of the opening of the second port.

5. The device according to claim 1, the end piece including a non-return valve arranged to close the communication between the first port and the passage of the first fluid.

6. The dispensing device according to claim 1, the end piece being moveable following the second displacement so as to open and close selectively the second port.

7. The dispensing device according to claim 1, the outlet port being selectively opened and closed by the insert when the end piece moves following the first displacement.

8. The dispensing device according to claim 1, the end piece being mounted movably relative to the insert following the third displacement.

9. The dispensing device according to claim 8, the insert having several passages of different sizes, the third displacement placing selectively one of said passages in communication with the second port.

10. The dispensing device according to claim 1, the end piece forming one of the first and second actuating element, the other of said elements including means of driving said end piece in the corresponding displacement.

11. The dispensing device according to claim 10, the first actuating element including a ring mounted so that it can rotate around the end piece to move said end piece in translation on the first displacement.

12. The dispensing device according to claim 1, the support including a passage permitting said reservoir to be in communication with the second port.

13. The dispensing device according to claim 1, the support including a means for mounting said device in the opening of a reservoir for the first fluid, said means being arranged to place said reservoir in communication with the first port.

14. The dispensing device according to claim 1, the insert including a plurality of projections to selectively stop the end piece at one of a plurality of positions relative to the insert.

15. A dispensing device for a drink based on a first fluid to which a second fluid can be added selectively, said device comprising:

a support containing a dispensing chamber having a first port communicating with a reservoir of said first fluid, a second port communicating with a reservoir of said second fluid, and an outlet port for said first and/or second fluids, and a dispensing assembly mounted movably relative to said support following:

a first displacement arranged to open and close said outlet port and/or the first port selectively, said device including a first actuating element for said first displacement, and a second displacement arranged to open and close said second port selectively, said device comprising a second actuating element to enable the actuation of said second displacement;

the second actuating element being arranged to be actuated, after the actuation of the first element and following a type of motion which is different to the motion necessary to actuate said first element, the dispensing assembly being mounted movably in relation to the support following a third displacement, which is arranged to control the size of the opening of the second port, further including a third actuating element for the third displacement, said third actuating element being arranged to be actuated in a type of motion which is different to the type of motion necessary for actuating the second actuating element.

16. The dispensing device according to claim 15, the third actuating element being arranged to drive the dispensing assembly in rotation at the third displacement.

17. A dispensing device for a drink based on a first fluid to which a second fluid can be added selectively, said device comprising:

a support containing a dispensing chamber having a first port communicating with a reservoir of said first fluid, a second port communicating with a reservoir of said second fluid, and an outlet port for said first and/or second fluids, and a dispensing assembly mounted movably relative to said support following:

a first displacement arranged to open and close said outlet port and/or the first port selectively, said device including a first actuating element for said first displacement, and a second displacement arranged to open and close said second port selectively, said device comprising a second actuating element to enable the actuation of said second displacement;

a third displacement, which is arranged to control the size of the opening of the second port;

the second actuating element being arranged to be actuated, after the actuation of the first element and following a type of motion which is different to the motion necessary to actuate said first element, the assembly being mounted movably such that the first and/or second displacements can be effected independently of the third displacement.

* * * * *